US008955376B2

(12) United States Patent
Pelletier

(10) Patent No.: US 8,955,376 B2
(45) Date of Patent: Feb. 17, 2015

(54) FORMATION FLUID SAMPLING CONTROL

(75) Inventor: Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/394,785

(22) PCT Filed: Oct. 22, 2009

(86) PCT No.: PCT/US2009/061640

§ 371 (c)(1), (2), (4) Date: May 24, 2012

(87) PCT Pub. No.: WO2011/049571

PCT Pub. Date: Apr. 28, 2011

(65) Prior Publication Data

US 2012/0222852 A1 Sep. 6, 2012

(51) Int. Cl.
*E21B 49/08* (2006.01)
*E21B 49/10* (2006.01)

(52) U.S. Cl.
CPC ..... *E21B 49/10* (2013.01)
USPC ..... 73/152.42

(58) Field of Classification Search
USPC ..... 73/152.23–153.24, 152.29–152.35, 73/152.37–152.38, 152.42
See application file for complete search history.

(56) References Cited

U.S. PATENT DOCUMENTS 3,731,530 A * 5/1973 Tanguy et al. ..... 73/152.42
5,692,565 A 12/1997 MacDougall et al.
5,741,977 A 4/1998 Agar et al.
6,332,111 B1 12/2001 Fincke
6,543,540 B2 4/2003 Woie et al.
6,609,568 B2 8/2003 Krueger et al.
6,986,282 B2 1/2006 Ciglenec et al.
7,222,524 B2 5/2007 Shammai
7,234,521 B2 6/2007 Shammai et al.
7,373,812 B2 * 5/2008 Ma et al. ..... 73/152.23
7,445,043 B2 11/2008 Mullins et al.
8,672,026 B2 * 3/2014 van Zuilekom et al. ..... 166/264
2004/0026076 A1 * 2/2004 Goodwin et al. ..... 166/66.6

(Continued)

FOREIGN PATENT DOCUMENTS

CN 1500966 A 6/2004
CN 1536198 A 10/2004
WO WO-2011049571 A1 4/2011

OTHER PUBLICATIONS

"Australian Application Serial No. 2009354176, Examiners First Report mailed Feb. 16, 2012", 2 pgs.

(Continued)

*Primary Examiner* — John Fitzgerald
(74) *Attorney, Agent, or Firm* — Schwegman Lundberg & Woessner, P.A.; Benjamin Fite

(57) ABSTRACT

In some embodiments, an apparatus and a system, as well as a method and an article, may operate a pump to obtain a formation fluid sample from a formation adjacent to a wellbore disposed within a reservoir, to detect a phase behavior associated with the fluid sample, and to adjust the volumetric pumping rate of the pump while repeating the operating and the detecting to maintain the pumping rate at a maintained rate, above which the phase behavior changes from a substantially single phase fluid flow to a substantially multi-phase flow. Additional apparatus, systems, and methods are disclosed.

21 Claims, 6 Drawing Sheets

(56) References Cited

U.S. PATENT DOCUMENTS

| | | | | |
|---|---|---|---|---|
| 2004/0104341 | A1 | 6/2004 | Betancourt et al. | |
| 2004/0221983 | A1 | 11/2004 | Ma et al. | |
| 2004/0231408 | A1 | 11/2004 | Shammai | |
| 2004/0260497 | A1 * | 12/2004 | DiFoggio et al. | 702/98 |
| 2010/0116493 | A1 * | 5/2010 | Irani et al. | 166/264 |
| 2010/0186948 | A1 * | 7/2010 | Sonne et al. | 166/162 |

OTHER PUBLICATIONS

"Australian Application Serial No. 2009354176, Preliminary Amendment Filed Dec. 6, 2011", 6 pgs.
"International Application Serial No. PCT/US2009/061640, Search Report mailed Dec. 18, 2009", 4 Pgs.
"International Application Serial No. PCT/US2009/061640, Written Opinion mailed Dec. 18, 2009", 13 Pgs.
"International Application Serial No. PCT/US2009/61640, International Preliminary Report on Patentability mailed Jan. 10, 2012", 13 pgs.
"International Application Serial No. PCT/US2009/61640, Written Opinion mailed Nov. 17, 2011", 5 pgs.
"International Application Serial No. PCT/US2009/61640, Written Opinion mailed Dec. 30, 2011", 4 pgs.
"Australian Application Serial No. 2009354176, Response filed Aug. 20, 2012 to Examiner Report mailed Feb. 16, 2012", 6 pgs.
"Chinese Application Serial No. 200980159782.0, Office Action mailed Feb. 5, 2013", (w/ English Translation), 12 pgs.
"Chinese Application Serial No. 200980159782.0, Response filed Jun. 19, 2013 to Office Action mailed Feb. 5, 2013", (w/ English Translation of Amended Claims), 12 pgs.
"European Application Serial 09850670.2, Examination Notification Art. 94(3) mailed Aug. 9, 23013", 4 pgs.
"European Application Serial No. 09850670.2, Extended European Search Report mailed Mar. 11, 2013", 7 pgs.
"Canadian Application Serial No. 2,765,477, Office Action mailed Jul. 22, 2013", 2 pgs.
"Chinese Application Serial No. 200980159782.0, Office Action mailed Nov. 4, 2013", 7 pgs.
"European Application Serial No. 09850670.2, Office Action mailed Mar. 28, 2013", 1 pg.
"European Application Serial No. 09850670.2, Response filed Jun. 20, 2013 to Office Action mailed Mar. 28, 2013", 19 pgs.
"European Application Serial 09850670.2, Response filed Oct. 9, 2013 to Examination Notification Art. 94(3) mailed Aug. 9, 2013", 10 pgs.

* cited by examiner

FORMATION FLUID SAMPLING CONTROL

RELATED APPLICATIONS

This application is a U.S. National Stage Filing under 35 U.S.C. 371 from International Patent Application Serial No. PCT/US2009/061640, filed Oct. 22, 2009, and published on Apr. 28, 2011 as WO 2011/049571 A1, the contents of which application and publication are incorporated herein by reference in their entirety.

BACKGROUND

Sampling programs are often conducted in the oil field to reduce risk. For example, the more closely that a given sample of formation fluid represents actual conditions in the formation being studied, the lower the risk of error induced during further analysis of the sample. This being the case, bottom hole samples are usually preferred over surface samples, due to errors which accumulate during separation at the well site, remixing in the lab, and the differences in measuring instruments and techniques used to mix the fluids to a composition that represents the original reservoir fluid. However, bottom hole sampling can also be costly in terms of time and money, such as when sampling time is increased because sampling efficiency is low.

DETAILED DESCRIPTION

Formation evaluation tools draw fluid samples from formations through the mud cake of a well bore. This fluid is then transported through sensors within the tool, perhaps through a pump and/or another set of sensors, and finally past a sampling valve for capture. The use of low pumping rates to preserve the formation can become inefficient when the time taken to extract fluid samples becomes longer than expected.

Various embodiments of the invention can operate to increase the efficiency of bottom hole fluid sampling by obtaining fluid samples at a volumetric pumping rate that operates to straddle the saturation pressure of the fluid in the reservoir. This helps to preserve the single phase nature of the fluid, while moving as much of the fluid as possible into the sampling chamber over time. To achieve this goal in many embodiments, the phase behavior of the fluid is evaluated several times during each stroke of the pump. The result of the evaluation is used to adjust the volumetric pumping rate.

Figure 1:
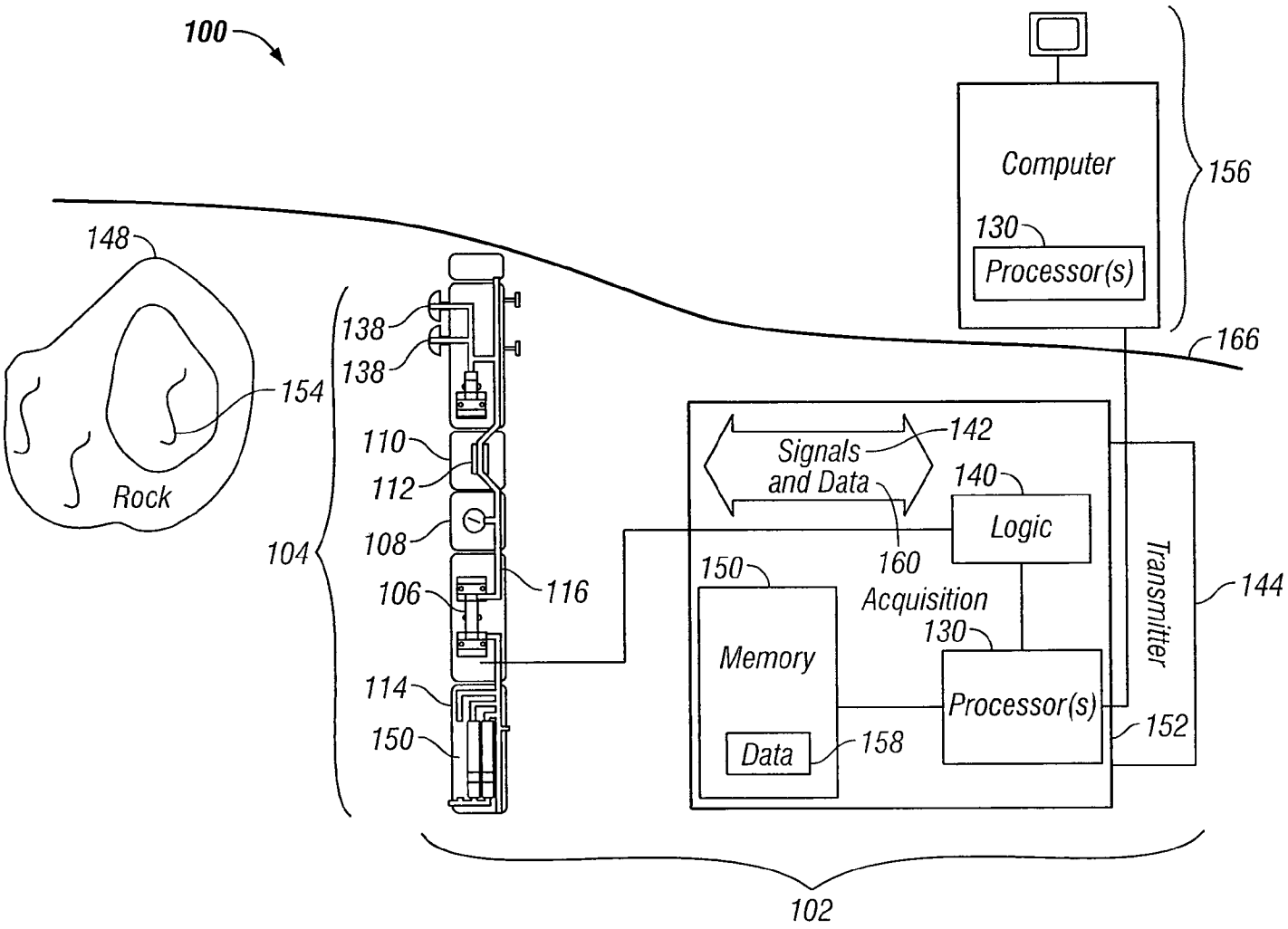
FIG. 1 is a block diagram of an apparatus according to various embodiments of the invention.

FIG. 1 is a block diagram of an apparatus 100 according to various embodiments of the invention. The apparatus 100 includes a downhole tool 102 (e.g., a pumped formation evaluation tool) comprising a fluid sampling device 104, which in turn includes a pressure measurement device 108 (e.g., pressure gauge, pressure transducer, strain gauge, etc.). The apparatus also includes a sensor section 110, which comprises a multi-phase flow detector 112.

The downhole tool 102 may comprise one or more probes 138 to touch the formation 148 and to extract fluid 154 from the formation 148. The tool also comprises at least one fluid path 116 that includes a pump 106. A sampling sub 114 (e.g., multi-chamber section) with the ability to individually select a fluid storage module 150 to which a fluid sample can be driven may exist between the pump 106 and the fluid exit from the tool 102. The pressure measurement device 108 and/or sensor section 110 may be located in the fluid path 116 so that saturation pressure can be measured while fluid 154 is pumped through the tool 102. It should be noted that, while the downhole tool 102 is shown as such, some embodiments of the invention may be implemented using a wireline logging tool body that includes the fluid sampling device 104. However, for reasons of clarity and economy, and so as not to obscure the various embodiments illustrated, this implementation has not been explicitly shown in this figure.

The apparatus 100 may also include logic 140, perhaps comprising a sampling control system. The logic 140 can be used to acquire formation fluid property data, such as saturation pressure.

The apparatus 100 may include a data acquisition system 152 to couple to the sampling device 104 and to receive signals 142 and data 160 generated by the pressure measurement device 108 and the sensor section 110. The data acquisition system 152, and any of its components, may be located downhole, perhaps in a tool housing, or at the surface 166, perhaps as part of a computer workstation 156 in a surface logging facility.

In some embodiments of the invention, the downhole apparatus 100 can operate to perform the functions of the workstation 156, and these results can be transmitted up hole or used to directly control the downhole sampling system.

The sensor section 110 may comprise one or more sensors, including a multi-phase flow detector 112 that comprises a densitometer, a bubble point sensor, a compressibility sensor, a speed of sound sensor, an ultrasonic transducer, a viscosity sensor, and/or an optical density sensor. It should be noted that a densitometer is often used herein as one example of a multiphase flow detector 112, but this is for reasons of clarity, and not limitation. That is, the other sensors noted above can be used in place of a densitometer, or in conjunction with it. In any case, the measurement signal(s) 142 provided by the sensor section 110 may be used as they are, or smoothed using analog and/or digital methods.

Variations from the signal output, such as a densitometer output that moves away from its historic average by more than one standard deviation (or by some number of standard deviations), in an expected direction (e.g., indicating a phase transition from liquid to gas, or from a retrograde gas to a liquid), indicates a change from a single-phase system to a multi-phase system, or from a multi-phase system to a single-phase system.

A control algorithm can thus be used to program the processor 130 to detect multi-phase flow. The volumetric fluid flow rate of the fluid 154 that enters the probes 138 as commanded by the pump 106 can be reduced from some initial (high) level to maintain a substantially maximum flow rate at which single phase flow can occur.

The pump 106 can be operated by the processor so that at the start of each pump stroke the flow rate is ramped up until two phase flow is detected by the densitometer (e.g., by detecting the presence of large variations in output from a historic average, where the significance of the amount of variation is determined by the standard deviation of the output from the average). At that point, the pumping rate can be ramped back down until the two phase flow indication shifts to an indication of single phase flow. This process can be repeated for changes in pump direction, whether the pump is pushing or pulling. Thus, the pump 106 may comprise a unidirectional pump or a bidirectional pump.

If the pumping rate is adjusted at the beginning of the stroke, the volume under test is minimized, providing a more sensitive measurement. In this way, the trend in onset pressures and disappearance behaviors brackets the actual saturation pressure, which can be plotted as a volume-based trend to predict the ultimate reservoir saturation pressure. Pressure and density can both be measured as the stroke continues.

When a high initial pumping rate is used, cavitation in the sample may occur, but as the volumetric flow rate is reduced, single-phase flow is achieved, and more efficient sampling occurs. This may operate to lower contamination in the sample, due to an average sampling pressure that is higher than what is provided by other approaches. In some embodiments, this same mechanism can be used with probes 138 of the focused sampling type to determine if the guard ring (surrounding an inner sampling probe) is removing enough fluid to effectively shield the inner probe. A telemetry transmitter 144 may be used to transmit data obtained from the multi-phase flow detector 112 and other sensors in the sensor section 110 to the processor 130, either downhole, or at the surface 166.

Figure 2:
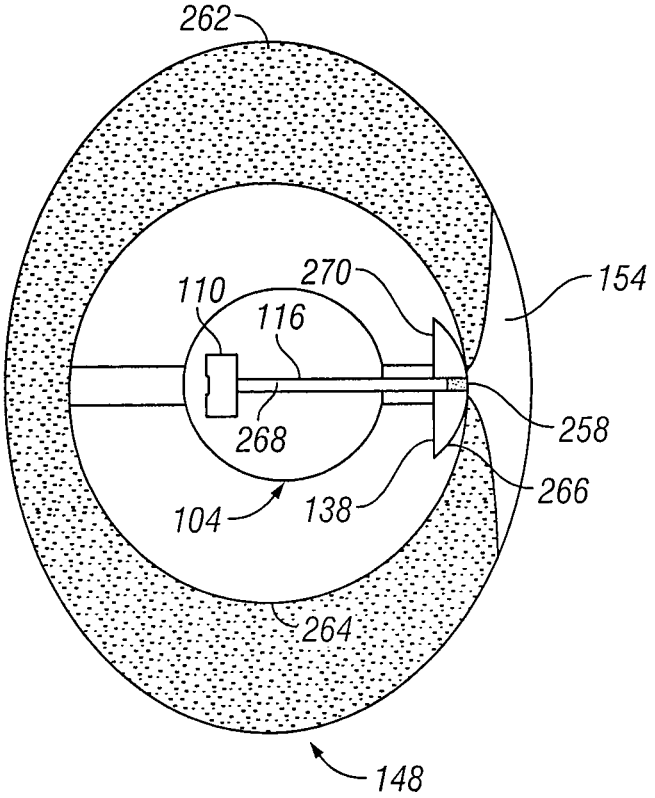
FIG. 2 is a top, cut-away view of the probe-formation interface according to various embodiments of the invention.

FIG. 2 is a top, cut-away view of the probe-formation interface 258 according to various embodiments of the invention. Here a single probe 138 is shown in cross-section. The filtrate 262 surrounding the well bore 264 is pulled into the probe 138 by the pump (not shown) in the fluid sampling device 104, creating a flow field of fluid 154 at the entrance to the probe 138. The fluid 154 flows along the path 116 as a one phase or multi-phase fluid 268, where its characteristics can be measured by the sensor section 110.

Consider the probe-formation interface 258. Interstitial volumes in the formation 148 are filled with the fluid 154. Pumping begins and fluid 154 move into the sampling device 104. Flow paths within the device 104 (e.g., path 116) are large in comparison to the mud-caked surface of the formation 148. The pumping rate can be ramped up until the differential pressure causes the fluid 154 in the reservoir to rupture the cake. This send some fluid 154 into the device 104 as well as some fines (e.g., detectable at the densitometer). The pump rate may continue to increase, bringing more fluid 154 in to the tool, until either a preset limit is imposed, or the densitometer output data indicates gas breakout from a liquid (e.g., bubble point) or liquid falls out from a gas (e.g., dew point). Either circumstance can operate to drive the densitometry measurements from indicating single phase smooth behavior to more transitory multi-phase transition behavior.

The probe-formation interface 258 is a point of relatively high differential pressure as the fluid 154 travels from the formation 148 to the inlet of the pump. The pressure wave invading the porous media (e.g., rock) in the formation 148 beyond the probe 138 moves away from the probe 138 as determined by geometry, viscosity of the fluid 154, and the pump rate. A relatively lower differential pressure on the formation fluid 154 is experienced in a very limited volume near the entrance to the probe 138, and this volume is actively swept into the probe 138 by the fluid 154 moving into the device 104. Once the changing pump rate has dropped sufficiently, below the saturation pressure of the fluid 154, the fluid 154 exhibits an apparent increase in viscosity due to relative permeability effects. The net result is foam generated in a limited volume near the entrance to the probe 138, which propagates into the device 104 along the path 116, eventually passing on to the sensor section 110.

The re-conversion of two phase fluid 268 to single phase fluid 154 can be accomplished by a reduction in the volumetric pumping rate. The time for the fluid 154 to actually reach the multi-phase flow detector for phase behavior detection will be driven by the total flow volume in the path 116 plus the volume of the fluid 154 currently located on the suction side of the pump.

The appearance and disappearance of two phase flow behavior at the multi-phase flow detector (e.g., densitometer) straddles the saturation pressure of the fluid 154, and the variance about each side of this pressure where fluid 154 is extracted from the formation 148 can be controlled to some extent by adjusting the rate at which the volumetric flow rate is changed (e.g., whether the pumping rate is changed in a linear fashion, or an exponential fashion). However, small changes in the pumping rate may also lengthen the time used to determine the saturation pressure of the fluid 154.

The volumetric pumping rate at the point of phase reconversion pressure is of interest because this turns out to be an efficient pumping rate. That is, a rate which operates to preserve the single phase nature of the fluid 154 while moving the maximum amount of fluid into the device 104.

Thus, referring now to FIGS. 1 and 2, it can be seen that many embodiments may be realized. For example, an apparatus 100 may comprise a pump 106 to obtain a formation fluid 154 sample from a formation 148 adjacent to a wellbore disposed within a reservoir, and a multi-phase flow detector 112 to detect phase behavior associated with the fluid 154 sample. The apparatus 100 may also comprise one or more processors 130 to adjust the volumetric pumping rate of the pump 106 to maintain the pumping rate at some maintained rate, above which the phase behavior changes from a substantially single phase fluid flow to a substantially multi-phase flow (e.g., a two phase flow).

As noted previously, the multi-phase flow detector 112 may comprise a number of devices from which the phase behavior of the fluid 154 sample may be determined. Thus, the multi-phase flow detector 112 may comprise one or more of a densitometer, a bubble point sensor, a compressibility sensor, a speed of sound sensor, an ultrasonic transducer, a viscosity sensor, or an optical density sensor.

The multi-phase flow detector 112 may also comprise a probe 138 of the focused sampling type to reduce the relative contamination level of the fluid 154 sample. The focused sampling probe 138 may have a guard ring 266 to shield an inner probe 270 hydraulically coupled to the pump 106 by the path 116.

In some embodiments, the apparatus 100 further comprises a fluid pressure measurement device 108 coupled to the processor 130. The fluid pressure measurement device 108 can be used to measure the pressure of the fluid 154 sample corresponding to the maintained rate to determine a formation fluid saturation pressure associated with the formation 148.

The rate of pumping can be changed in a linear or non-linear fashion, perhaps depending on whether the stroke has just started, or has been underway for some time. Thus, in some embodiments, the pumping rate can be adjusted by the processor 130 in a substantially linear fashion, or a substantially non-linear fashion.

The pumping rate can even be adjusted over each stroke of the pump, starting at a low or high value, and ramping up/down to reach the maintained value. Thus, the processor 130 may be used to adjust the pumping rate for each stroke of the pump, beginning at a rate (e.g., a relatively high rate) selected to provide a substantially multi-phase fluid flow.

A memory 150 that includes a log history 158 associated with pumping operations in the wellbore can be used to establish an average value of some measurement associated with the fluid 154 sample. This value can be used to determine the phase behavior of the fluid 154. Thus, in some embodiments, the apparatus 100 comprises a memory 150 to store a log history 158 associated with the wellbore, the log history 158 comprising data from which an average measurement value of the multi-phase flow detector 112 can be determined.

Telemetry can be used to transmit down-hole data 160 to a processor located downhole or at the surface. Thus, the apparatus 100 may comprise a telemetry transmitter 144 to transmit data 160 obtained from the multi-phase flow detector 112 (and other sensors in the sensor section 110) to the processor 130. Still further embodiments may be realized.

Figure 3:
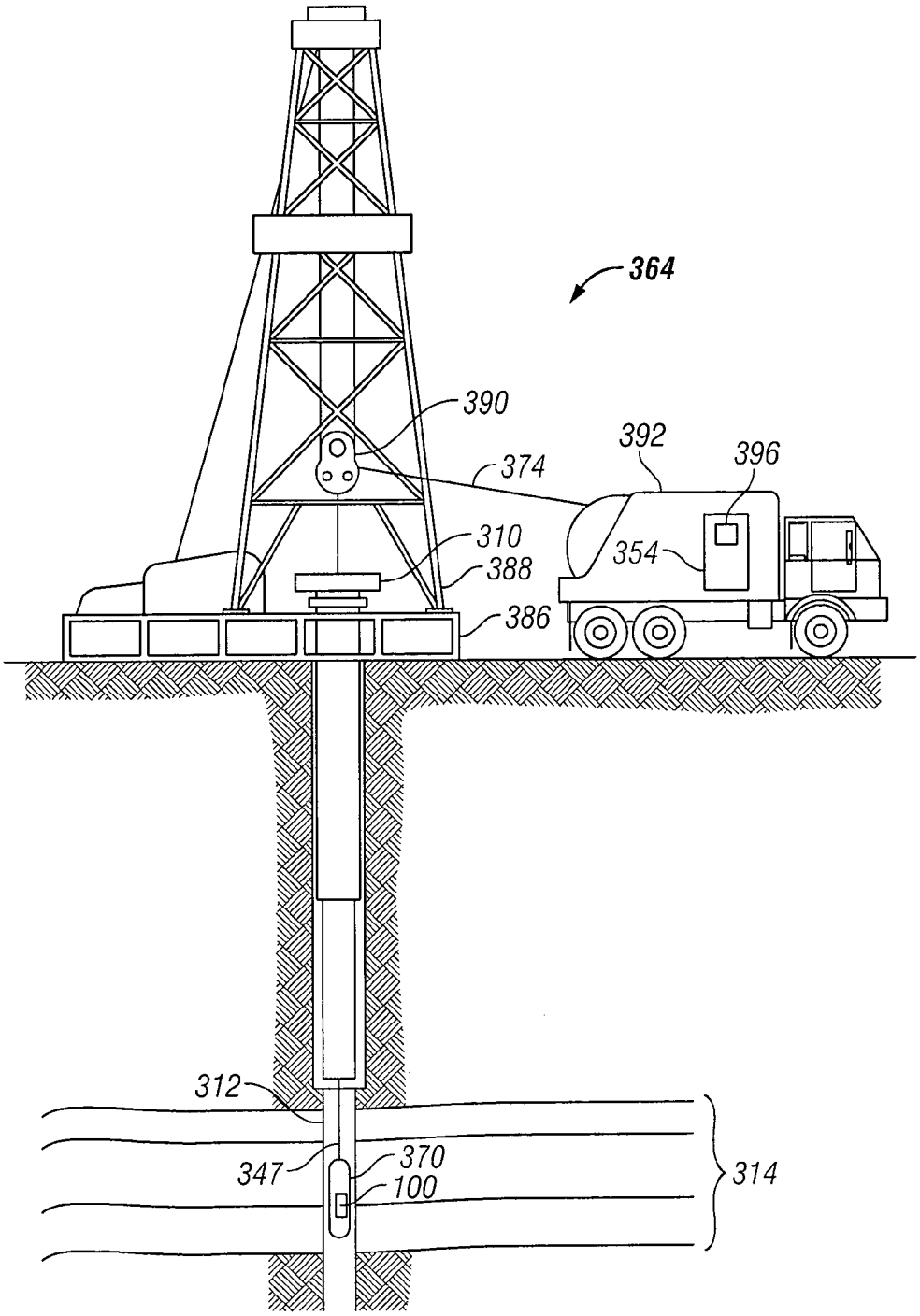
FIG. 3 illustrates a wireline system embodiment of the invention.
Figure 4:
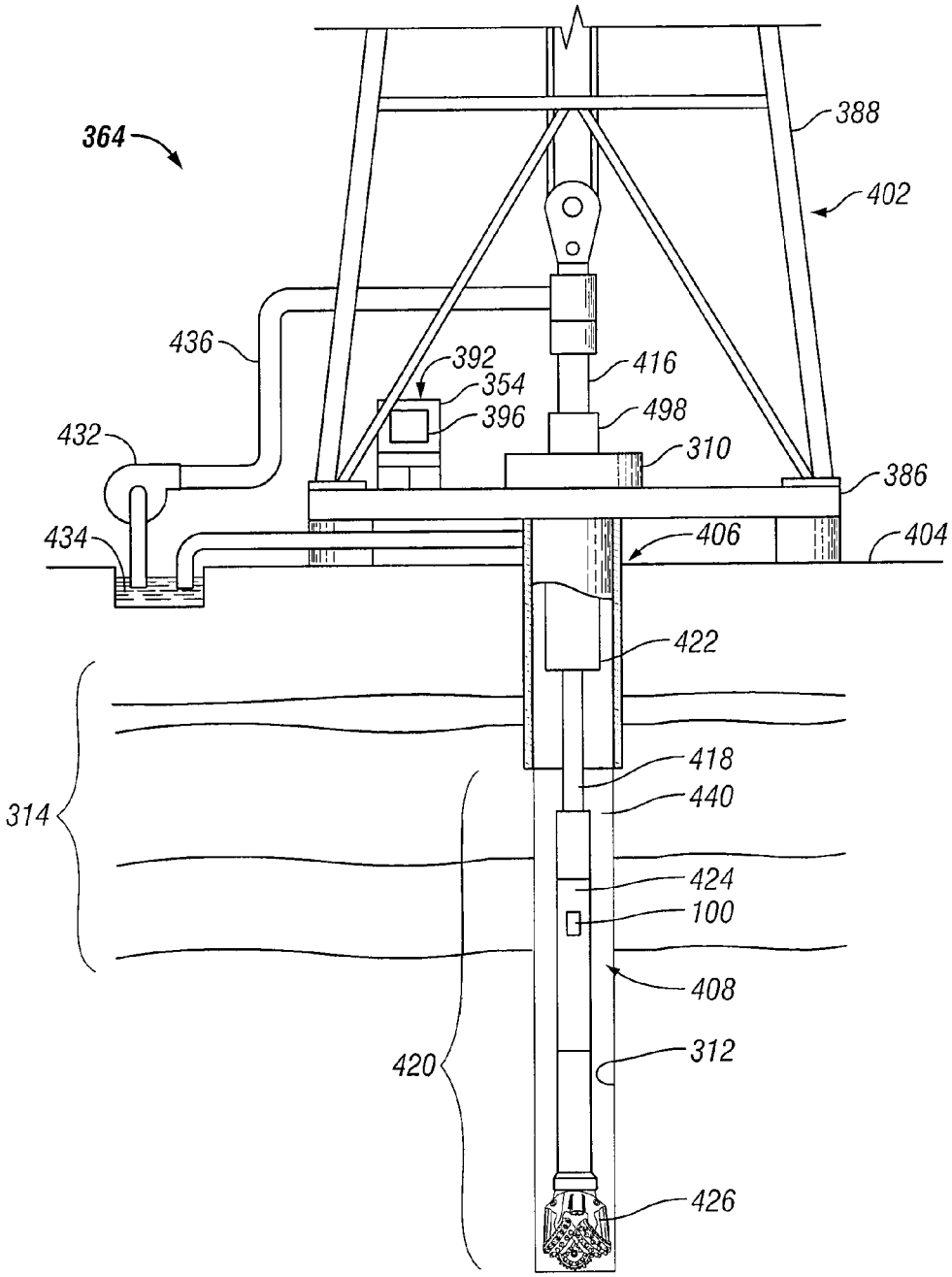
FIG. 4 illustrates a drilling rig system embodiment of the invention.

For example, FIG. 3 illustrates a wireline system 364 embodiment of the invention, and FIG. 4 illustrates a drilling rig system 364 embodiment of the invention. Thus, the systems 364 may comprise portions of a tool body 370 as part of a wireline logging operation, or of a downhole tool 424 as part of a downhole drilling operation.

FIG. 3 shows a well during wireline logging operations. A drilling platform 386 is equipped with a derrick 388 that supports a hoist 390.

Drilling of oil and gas wells is commonly carried out using a string of drill pipes connected together so as to form a drilling string that is lowered through a rotary table 310 into a wellbore or borehole 312. Here it is assumed that the drill string has been temporarily removed from the borehole 312 to allow a wireline logging tool body 370, such as a probe or sonde, to be lowered by wireline or logging cable 374 into the borehole 312. Typically, the tool body 370 is lowered to the bottom of the region of interest and subsequently pulled upward at a substantially constant speed.

During, the upward trip, at a series of depths the tool movement can be paused and the tool set to pump fluids into the instruments (e.g., the sampling device 104, the sensor section 110, and the pressure measurement device 108 shown in FIG. 1) included in the tool body 370 may be used to perform measurements on the subsurface geological formations 314 adjacent the borehole 312 (and the tool body 370). The measurement data can be communicated to a surface logging facility 392 for storage, processing, and analysis. The logging facility 392 may be provided with electronic equipment for various types of signal processing, which may be implemented by any one or more of the components of the apparatus 100 in FIG. 1. Similar formation evaluation data may be gathered and analyzed during drilling operations (e.g., during logging while drilling (LWD) operations, and by extension, sampling while drilling).

In some embodiments, the tool body 370 comprises a formation testing tool for obtaining and analyzing a fluid sample from a subterranean formation through a wellbore. The formation testing tool is suspended in the wellbore by a wireline cable 374 that connects the tool to a surface control unit (e.g., comprising a workstation 156 in FIG. 1 or 354 in FIGS. 3-4). The formation testing tool may be deployed in the wellbore on coiled tubing, jointed drill pipe, hard wired drill pipe, or any other suitable deployment technique.

As is known to those of ordinary skill in the art, the formation testing tool may comprise an elongated, cylindrical body having a control module, a fluid acquisition module, and fluid storage modules. The fluid acquisition module may comprise an extendable fluid admitting probe (e.g., see probes 138 in FIGS. 1 and 2) and extendable tool anchors. Fluid can be drawn into the tool through one or more probes by a fluid pumping unit. The acquired fluid then flows through one or more fluid measurement modules (e.g., elements 108 and 110 in FIG. 1) so that the fluid can be analyzed using the techniques described herein. Resulting data can be sent to the workstation 354 via the wireline cable 374. The fluid that has been sampled can be stored in the fluid storage modules (e.g., elements 150 in FIG. 1) and retrieved at the surface for further analysis.

Turning now to FIG. 4, it can be seen how a system 364 may also form a portion of a drilling rig 402 located at the surface 404 of a well 406. The drilling rig 402 may provide support for a drill string 408. The drill string 408 may operate to penetrate a rotary table 310 for drilling a borehole 312 through subsurface formations 314. The drill string 408 may include a Kelly 416, drill pipe 418, and a bottom hole assembly 420, perhaps located at the lower portion of the drill pipe 418.

The bottom hole assembly 420 may include drill collars 422, a downhole tool 424, and a drill bit 426. The drill bit 426 may operate to create a borehole 312 by penetrating the surface 404 and subsurface formations 314. The downhole tool 424 may comprise any of a number of different types of tools including MWD (measurement while drilling) tools, LWD tools, and others.

During drilling operations, the drill string 408 (perhaps including the Kelly 416, the drill pipe 418, and the bottom hole assembly 420) may be rotated by the rotary table 310. In addition to, or alternatively, the bottom hole assembly 420 may also be rotated by a motor (e.g., a mud motor) that is located downhole. The drill collars 422 may be used to add weight to the drill bit 426. The drill collars 422 may also operate to stiffen the bottom hole assembly 420, allowing the bottom hole assembly 420 to transfer the added weight to the drill bit 426, and in turn, to assist the drill bit 426 in penetrating the surface 404 and subsurface formations 314.

During drilling operations, a mud pump 432 may pump drilling fluid (sometimes known by those of skill in the art as "drilling mud") from a mud pit 434 through a hose 436 into the drill pipe 418 and down to the drill bit 426. The drilling fluid can flow out from the drill bit 426 and be returned to the surface 404 through an annular area 440 between the drill pipe 418 and the sides of the borehole 312. The drilling fluid may then be returned to the mud pit 434, where such fluid is filtered. In some embodiments, the drilling fluid can be used to cool the drill bit 426, as well as to provide lubrication for the drill bit 426 during drilling operations. Additionally, the drilling fluid may be used to remove subsurface formation 314 cuttings created by operating the drill bit 426.

Thus, referring now to FIGS. 1-4, it may be seen that in some embodiments, the system 364 may include a downhole tool 424, and/or a wireline logging tool body 370 to house one or more apparatus 100, similar to or identical to the apparatus 100 described above and illustrated in FIG. 1. Thus, for the purposes of this document, the term "housing" may include any one or more of a downhole tool 102, 424 or a wireline logging tool body 370 (each having an outer wall that can be used to enclose or attach to instrumentation, sensors, fluid sampling devices, pressure measurement devices, and data acquisition systems). The downhole tool 102, 424 may comprise an LWD tool or MWD tool. The tool body 370 may comprise a wireline logging tool, including a probe or sonde, for example, coupled to a logging cable 374. Many embodiments may thus be realized.

For example, in some embodiments, a system 364 may include a display 396 to present the pumping volumetric flow rate and/or measured saturation pressure information, perhaps in graphic form. A system 364 may also include computation logic, perhaps as part of a surface logging facility 392, or a computer workstation 354, to receive signals from fluid sampling devices, multi-phase flow detectors, pressure measurement devices, and other instrumentation to determine adjustments to be made to the pump in a fluid sampling device and to measure the resulting formation fluid saturation pressure.

Thus, a system 364 may comprise a downhole tool 102, 424, and one or more apparatus 100 at least partially housed by the downhole tool 102, 424. The apparatus 100 is used to adjust fluid sampling device volumetric flow rates, and may comprise a processor, a pump, and a multi-phase flow detector, as noted previously.

The apparatus 100; downhole tool 102; fluid sampling device 104; pump 106; pressure measurement device 108; sensor section 110; multi-phase flow detector 112; sampling sub 114; fluid path 116; processors 130; probes 138; logic 140; transmitter 144; storage module 150; data acquisition system 152; workstations 156, 354; guard ring 266; inner probe 270; rotary table 310; systems 364; tool body 370; drilling platform 386; derrick 388; hoist 390; logging facility 392; display 396; drilling rig 402; drill string 408; Kelly 416; drill pipe 418; bottom hole assembly 420; drill collars 422; downhole tool 424; drill bit 426; mud pump 432; and hose 436 may all be characterized as "modules" herein. Such modules may include hardware circuitry, and/or a processor and/or memory circuits, software program modules and objects, and/or firmware, and combinations thereof, as desired by the architect of the apparatus 100 and systems 364, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus 100 and systems 364 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules. Such apparatus and systems may further be included as subcomponents within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 5:
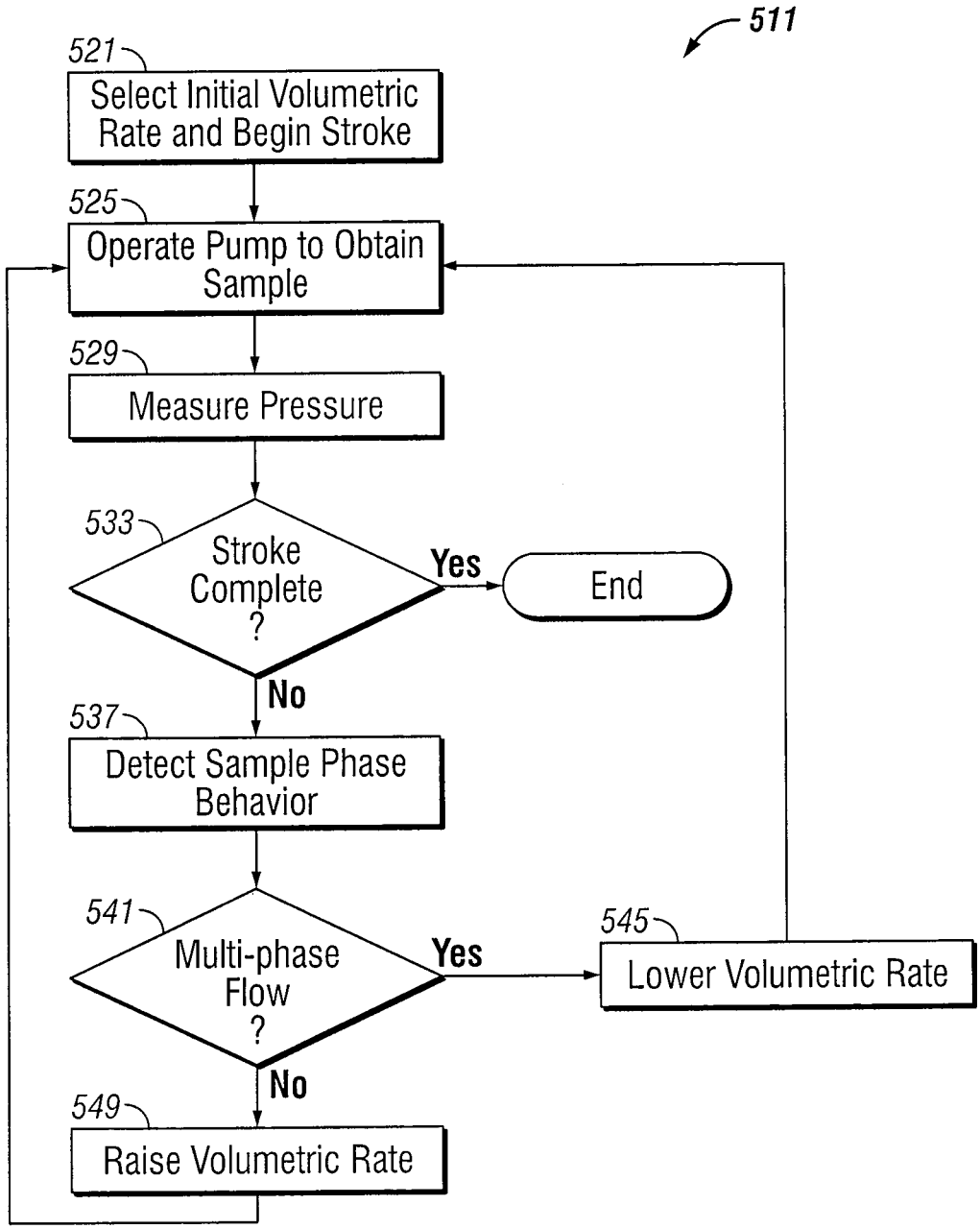
FIG. 5 is a flow chart illustrating several methods according to various embodiments of the invention.

For example, FIG. 5 is a flow chart illustrating several methods 511 according to various embodiments of the invention. Thus, a method 511 of controlling formation fluid sampling may begin at block 521 with selecting an initial volumetric pumping rate, and beginning the pump stroke at the selected rate.

In some embodiments, as the fluid is pulled into the pump, the historic behavior of the fluid can be recorded, and used to direct future pumping efforts, even to the level of changing pumping behavior between strokes, and during a stroke. In this way, the initial pumping rate for each stroke may be selected based on a log history of the wellbore. Therefore, adjustments to the pumping rate may comprise selecting an initial pumping rate to provide a substantially multi-phase fluid flow based on a log history associated with the wellbore, for example.

The method 511 may continue on to block 525 with operating the pump to obtain a formation fluid sample from a formation adjacent to a wellbore disposed within a reservoir. The pump may be operated as a unidirectional or bidirectional pump. Thus, the activity at block 525 may comprise operating a multi-direction pump.

The formation fluid saturation pressure can be determined by measuring the pressure of the fluid sample while the pumping rate is held at a maintained rate. Thus, in some embodiments, the method 511 comprises, at block 529, measuring the pressure of the fluid sample corresponding to a rate maintained to determine a formation fluid saturation pressure associated with the formation.

The method 511 may continue on to block 533 to determine if the pump stroke is complete. If so, the method 511 may end. In some embodiments, the method 511 may alternatively operate to return to blocks 521 or 525 to continue with another stroke. If the pump stroke is not complete, as determined at block 533, then the method 511 may continue on to block 537 with detecting phase behavior associated with the fluid sample.

Among other devices, a densitometer can be used to determine phase behavior of the fluid sample. The densitometer output may be sampled at rates ranging from about 50 samples/second to 150 samples/second in some embodiments, providing fine control over the pump behavior. Thus, the activity at block 537 may include monitoring a densitometer to determine the phase behavior.

Single phase flow behavior may be established when the measured value associated with the fluid sample (e.g., the density of the samples) lies within a designated distance of a selected, historical measurement value, such as a running average. Thus, the activity at block 537 may comprise detecting the phase behavior as comprising a substantially single phase fluid flow when a current measurement value associated with the fluid sample is within a selected distance of a selected value associated with the fluid sample.

The distance from the historical value may be defined in terms of a percentage of an average value, or some number of standard deviations from the average value, among others. Thus, in some embodiments, the selected distance comprises a percentage of the average measurement value, a percentage of a prior measurement value, or a number of standard deviation values associated with the average measurement value.

One historical value among many that can be measured and used is an average density of the fluid sample. Thus, the activity at block 537 may comprise determining the average measurement value associated with the fluid sample as an average density of the fluid sample.

The method 511 may continue on to block 541 to determine whether multi-phase flow has been detected. The method 511 may continue on to either of blocks 545 or 549, to include adjusting the volumetric pumping rate of the pump while repeating the operating activity (at block 525) and the detecting activity (at block 537) to maintain the pumping rate at a maintained rate, above which the phase behavior changes from a substantially single phase fluid flow to a substantially multi-phase flow.

For example, if multi-phase flow is not detected, as determined at block 541, the method 511 may continue on to block 549 with raising the rate. On the other hand, the pumping rate can be started at a relatively high value—one designed to induce cavitation in the fluid sample, before being ramped down to a lower value that provides single phase flow in the fluid sample. Thus, if the method 511 includes selecting an initial pumping rate to provide the substantially multi-phase fluid flow at block 521, and the multi-phase flow is detected at block 541, the method 511 may continue on to block 545 with reducing the pumping rate from the initial pumping rate while repeating the operating activity (at block 525), until the pumping rate reaches the rate maintained to provide substantially single phase flow behavior. That is, the rate which straddles the point between single phase and multi-phase flow.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 100 and systems 364 may be implemented in a machine-accessible and readable medium that is operational over one or more networks. The networks may be wired, wireless, or a combination of wired and wireless. The apparatus 100 and systems 364 can be used to implement, among other things, the processing associated with the methods 511 of FIG. 5. Modules may comprise hardware, software, and firmware, or any combination of these. Thus, additional embodiments may be realized.

Figure 6:
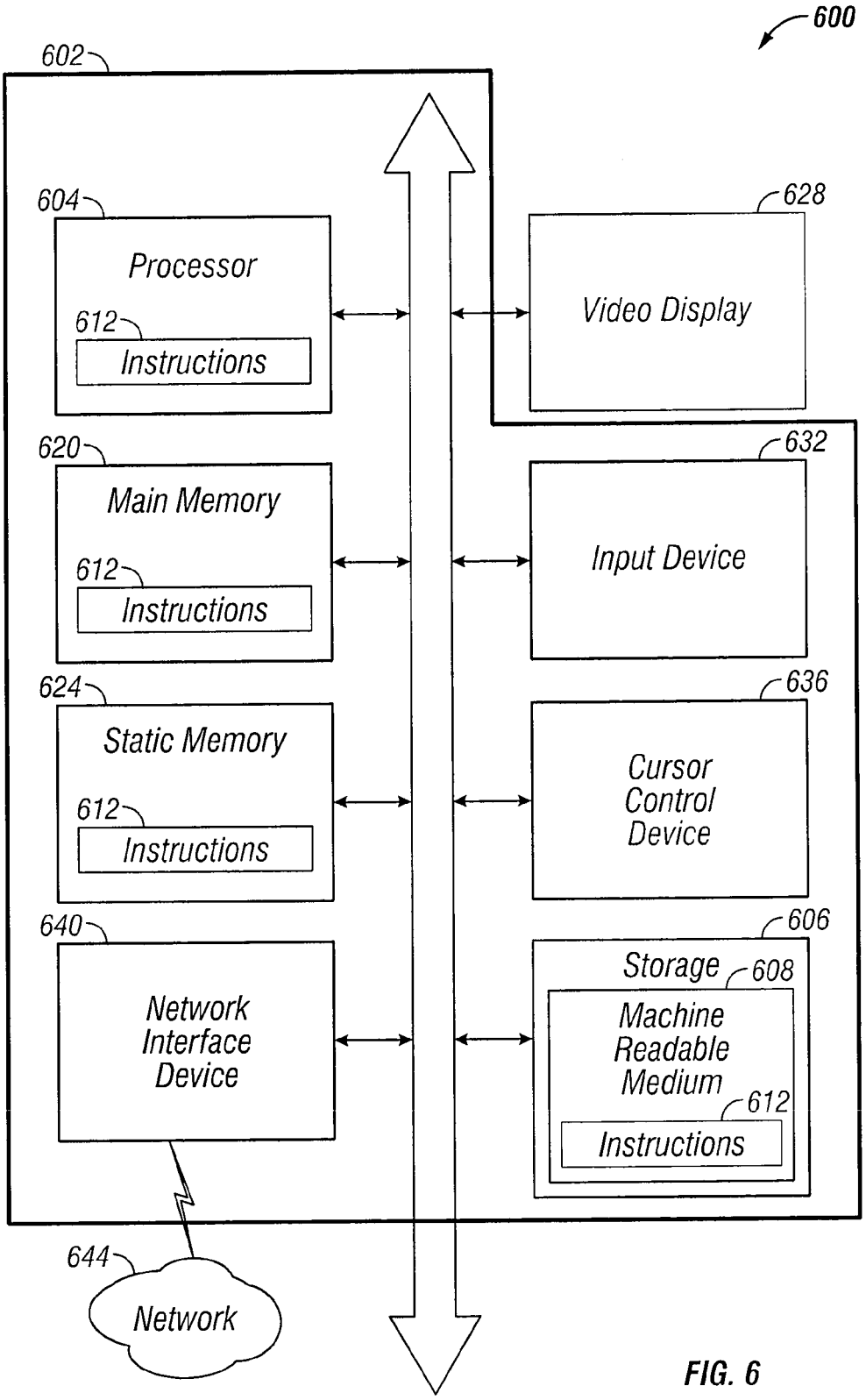
FIG. 6 is a block diagram of an article of manufacture, including a specific machine, according to various embodiments of the invention.

For example, FIG. 6 is a block diagram of an article 600 of manufacture, including a specific machine 602, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 600 of manufacture, such as a computer, a memory system, a magnetic or optical disk, some other storage device, and/or any type of electronic device or system may include one or more processors 604 coupled to a machine-readable medium 608 such as a memory (e.g., removable storage media, as well as any memory including an electrical, optical, or electromagnetic conductor) having instructions 612 stored thereon (e.g., computer program instructions), which when executed by the one or more processors 604 result in the machine 602 performing any of the actions described with respect to the methods above.

The machine 602 may take the form of a specific computer system having a processor 604 coupled to a number of components directly, and/or using a bus 616. Thus, the machine 602 may be incorporated into the apparatus 100 or system 364 shown in FIGS. 1 and 3-4, perhaps as part of the processor 130, or the workstation 354.

Turning now to FIG. 6, it can be seen that the components of the machine 602 may include main memory 620, static or non-volatile memory 624, and mass storage 606. Other components coupled to the processor 604 may include an input device 632, such as a keyboard, or a cursor control device 636, such as a mouse. An output device 628, such as a video display, may be located apart from the machine 602 (as shown), or made as an integral part of the machine 602.

A network interface device 640 to couple the processor 604 and other components to a network 644 may also be coupled to the bus 616. The instructions 612 may be transmitted or received over the network 644 via the network interface device 640 utilizing any one of a number of well-known transfer protocols (e.g., HyperText Transfer Protocol). Any of these elements coupled to the bus 616 may be absent, present singly, or present in plural numbers, depending on the specific embodiment to be realized.

The processor 604, the memories 620, 624, and the storage device 606 may each include instructions 612 which, when executed, cause the machine 602 to perform any one or more of the methods described herein. In some embodiments, the machine 602 operates as a standalone device or may be connected (e.g., networked) to other machines. In a networked environment, the machine 602 may operate in the capacity of a server or a client machine in server-client network environment, or as a peer machine in a peer-to-peer (or distributed) network environment.

The machine 602 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 602 is illustrated, the term "machine" shall also be taken to include any collection of machines that individually or jointly execute a set (or multiple sets) of instructions to perform any one or more of the methodologies discussed herein.

While the machine-readable medium 608 is shown as a single medium, the term "machine-readable medium" should be taken to include a single medium or multiple media (e.g., a centralized or distributed database, and/or associated caches and servers, and or a variety of storage media, such as the registers of the processor 604, memories 620, 624, and the storage device 606 that store the one or more sets of instructions 612. The term "machine-readable medium" shall also be taken to include any medium that is capable of storing, encoding or carrying a set of instructions for execution by the machine and that cause the machine 602 to perform any one or more of the methodologies of the present invention, or that is capable of storing, encoding or carrying data structures utilized by or associated with such a set of instructions. The terms "machine-readable medium" or "computer-readable medium" shall accordingly be taken to include tangible media, such as solid-state memories and optical and magnetic media.

Various embodiments may be implemented as a stand-alone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may provide volumetric flow rates for bottom hole fluid sampling that increase pumping efficiency, while substantially preserving single phase flow. Damage to the formation may be reduced as a result. In addition, samples that are captured may have less contamination, and be obtained earlier in time. This combination can significantly reduce risk to the operation/exploration company while at the same time helping to control sampling-time related costs.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a pump to draw into and command through the apparatus, including through the pump, a flow of a formation fluid sample from a formation adjacent to a wellbore disposed within a reservoir, the pump being a pump structured to operate using a number of strokes, a stroke of the pump being in one pump direction from a stroke starting location to a stroke completion location to provide fluid flow;

a multi-phase flow detector to detect a phase behavior associated with the formation fluid sample in the flow drawn into the apparatus by the pump; and a processor to operate the pump over a stroke, beginning at a volumetric flow rate sufficient to reduce pressure within the pump to less than a saturation pressure of the formation fluid sample, continuing the stroke while reducing the volumetric flow rate until reaching a reduced volumetric flow rate where a substantially single phase fluid flow associated with the formation fluid sample is detected by the detector, and maintaining the reduced volumetric flow rate as a maintained rate during the stroke until the end of the stroke is reached.

2. The apparatus of claim 1, wherein the multi-phase flow detector comprises:

at least one of a densitometer, a bubble point sensor, a compressibility sensor, a speed of sound sensor, an ultrasonic transducer, a viscosity sensor, or an optical density sensor.

3. The apparatus of claim 1, further comprising:

a focused sampling probe having a guard ring to shield an inner probe hydraulically coupled to the pump.

4. The apparatus of claim 1, further comprising:

a fluid pressure measurement device coupled to the processor to measure a pressure of the formation fluid sample corresponding to the maintained rate to determine a formation fluid saturation pressure associated with the formation.

5. The apparatus of claim 1, wherein the pump comprises a bidirectional pump.

6. The apparatus of claim 1, wherein a pumping rate of the pump can be adjusted by the processor in a substantially linear fashion, or a substantially non-linear fashion.

7. The apparatus of claim 1, wherein the processor is to adjust a pumping rate for each stroke of the pump, beginning at a rate selected to provide a substantially multi-phase fluid flow.

8. The apparatus of claim 1, wherein the multi-phase flow detector and the processor are operable at a plurality of different times during the stroke of the pump to evaluate the phase behavior associated with the formation fluid sample.

9. A system, comprising:

a downhole tool;

a pump and a multi-phase flow detector at least partially housed by the downhole tool, the pump to draw into and command through the apparatus, including through the pump, a flow of a formation fluid sample from a formation adjacent to a wellbore disposed within a reservoir, the pump being a pump structured to operate using a number of strokes, a stroke of the pump being in one pump direction from a stroke starting location to a stroke completion location to provide fluid flow, and the multi-phase flow detector to detect a phase behavior associated with the formation fluid sample in the flow drawn into the apparatus by the pump; and a processor to operate the pump over a stroke, beginning at a volumetric flow rate sufficient to reduce pressure within the pump to less than a saturation pressure of the formation fluid sample, continuing the stroke while reducing the volumetric flow rate until reaching a reduced volumetric flow rate where a substantially single phase fluid flow associated with the formation fluid sample is detected by the detector, and maintaining the reduced volumetric flow rate as a maintained rate during the stroke until the end of the stroke is reached.

10. The system of claim 9, wherein the downhole tool comprises one of a wireline tool or a measurement while drilling tool.

11. The system of claim 9, further comprising:

a memory to store a log history associated with the wellbore, the log history comprising data from which an average measurement value of the multi-phase flow detector can be determined.

12. The system of claim 9, further comprising:

a telemetry transmitter to transmit data obtained from the multi-phase flow detector to the processor.

13. A method, comprising:

operating a pump to draw into and command through a fluid sampling device, including through the pump, a flow of a formation fluid sample from a formation adjacent to a wellbore disposed within a reservoir, the operating to include beginning a stroke of the pump at a volumetric flow rate sufficient to reduce pressure within the pump to less than a saturation pressure of the formation fluid sample, the pump being a pump structured to operate using a number of strokes, the stroke of the pump being in one pump direction from a stroke starting location to a stroke completion location to provide fluid flow;

continuing the stroke while reducing the volumetric flow rate until reaching a reduced volumetric flow rate where a substantially single phase fluid flow associated with the formation fluid sample is detected; and maintaining the reduced volumetric flow rate as a maintained rate during the stroke until reaching the end of the stroke.

14. The method of claim 13, wherein the operating comprises:

operating a multi-direction pump.

15. The method of claim 13, wherein the substantially single phase fluid flow associated with the formation fluid sample is detected by monitoring a densitometer to determine phase behavior.

16. The method of claim 13 further comprising:

measuring pressure of the formation fluid sample corresponding to the maintained rate to determine a formation fluid saturation pressure associated with the formation.

17. The method of claim 13, further comprising:

repeating the operating, the continuing, and the maintaining over multiple strokes of the pump.

18. The method of claim 13, wherein the volumetric flow rate sufficient to reduce the pressure within the pump to less than the saturation pressure is determined by selecting an initial pumping rate to provide a substantially multi-phase fluid flow based on a log history associated with the wellbore.

19. The method of claim 13, wherein phase behavior of the formation fluid sample is detected as comprising the substantially single phase fluid flow when a current measurement value associated with the formation fluid sample is within a selected distance of a selected value associated with the formation fluid sample.

20. The method of claim 19, wherein the selected distance comprises a percentage of the average measurement value, a percentage of a prior measurement value, or a number of standard deviation values associated with the average measurement value.

21. The method of claim 20, further comprising:

determining the average measurement value associated with the formation fluid sample as an average density of the formation fluid sample.

* * * * *